United States Patent [19]

Blotenberg

[11] Patent Number: 4,968,215

[45] Date of Patent: Nov. 6, 1990

[54] DEVICE FOR CONTROL OF A TURBOCOMPRESSOR

[75] Inventor: Wilfried Blotenberg, Dinslaken, Fed. Rep. of Germany

[73] Assignee: Man Gutehoffnungshutte, Oberhausen, Fed. Rep. of Germany

[21] Appl. No.: 205,496

[22] Filed: Jun. 6, 1988

Related U.S. Application Data

[63] Continuation-in-part of Ser. No. 930,354, Nov. 12, 1986, abandoned.

[30] Foreign Application Priority Data

Nov. 13, 1985 [DE] Fed. Rep. of Germany ..... 3540284

[51] Int. Cl.[5] ..... F04D 27/02

[52] U.S. Cl. ..... 415/27

[58] Field of Search ..... 415/26, 27, 28; 417/26, 417/27

[56] References Cited

U.S. PATENT DOCUMENTS

| | | | |
|---|---|---|---|
| 3,276,674 | 10/1966 | Hens | 415/28 |
| 4,046,490 | 9/1977 | Rutshtein et al. | 415/27 |
| 4,139,328 | 2/1979 | Kuper et al. | 415/27 |
| 4,142,838 | 3/1979 | Staroselsky | 417/26 |
| 4,384,818 | 5/1983 | Blotenberg | 415/27 |
| 4,428,194 | 1/1984 | Stokes et al. | 415/27 |
| 4,627,788 | 12/1986 | Keyes et al. | 415/27 |

*Primary Examiner*—Louis J. Casaregola
*Attorney, Agent, or Firm*—McGlew and Tuttle

[57] ABSTRACT

An anti-surge control of a turbocompressor includes a controller which controls the progressive opening or closing of a blow-off valve as a function of the working point location relative to a blow-off line defined in the characteristic field. A quick opening of the blow-off valve upon the occurrence of a close approach to surge is effective by applying a correction signal to the integral section of the controller.

5 Claims, 3 Drawing Sheets

DEVICE FOR CONTROL OF A TURBOCOMPRESSOR

This application is a continuation-in-part, of application Ser. No. 930,354, filed Nov. 12, 1986 (abandoned).

FIELD AND BACKGROUND OF THE INVENTION

This invention relates in general to compressors and in particular to a new and useful device for controlling a turbo compressor to prevent surge.

Surging is an instable condition of a turbo-compressor, in which the conveying medium flows by jerks and jolts or periodically from the pressure side to the suction side. A performance graph based on performance characteristics of the turbocompressor such as discharge pressure and volume rate of flow of the compressor may be plotted to define a surge limit line. The surge limit line separates the stable area from the instable area. For surge limit control of the turbocompressor a blow-off line is defined in the performance graph. The blow-off line is spaced at a safety distance from the surge limit line.

In known surge controllers the instantaneous working point of the compressor in the performance graph is registered, and if the working point approaches the blow-off line, the control opens a blow-off or by-pass valve, which is connected to the outlet line of the compressor. This lowers the discharge pressure, before the working point approaches the instable area. However, if the working point changes quickly, this control may not react fast enough. This fast working point change may result in the working point crossing the blow-off line and the working point may possibly reach the surge control line.

In order to avoid this it is provided that if the working point crosses a safety line, which can be identical to the blow-off line or lie between this line and the surge control line, an additional signal is generated, which carriers out a fast, complete or partial opening of the blow-off valve.

In the case of the installation known from the U.S. Pat. No. 4 142 838 this additional signal is combined with the output signal of the control. Here the problem arises, that this correcting signal has to be eliminated after the disturbance. This is obtained in the known installation by allowing the correction signal to fade out (die down) according to a time function. The time constant of this time function has to be adapted to the adjustment behavior of the control, because the fading out (decay) of the correcting signal is a disturbance for the closed-loop control system, which has to be corrected by the control. During this fading-out time (relaxation time) the working point of the compressor is situated behind the blow-off line (i.e. toward the surge limit line).

It is also imaginable to combine the correction signal triggering the fast opening of the blow-off valve to the controller's input signal, or to a setpoint. But this has the disadvantage that the influence of the correction signal on the blow-off valve is delayed according to the controller's time behavior and that the controller's amplification factor also determines the intensity of the correction signal. This means a restriction in the free choice of controller parameters which may be used.

SUMMARY OF THE INVENTION

It is an object of the invention to develop a turbocompressor control system in such a way, that by using easy means an instantaneous effect of the correcting signal on the control of the blow-off valve may be obtained, without need of special measures, of subsequent compensation of the correcting signal and without the risk that the working point lies beyond the blow-off line (in the direction of surge) for a lengthy period of time.

According to the invention, a controller is provided including a proportional controller receiving an input set point signal and outputting a signal having a value proportional to the set point signal and an integral controller for receiving the input set point signal and outputting a signal which is the integral of the set point signal, as a function of time. A signal forming stage is provided for receiving a trigger signal indicating a working point beyond the blow-off line and generating a correction signal in the form of one or more pulses. The correction signal is input to the integral controller so as to intensify the output of the controller which includes the output of the integral controller and the proportional controller.

The invention preferably has an input control signal or setpoint signal which is formed utilizing a first sensor means associated with an upstream line of the turbocompressor for sensing volumetric flow in the upstream line and forming a signal representative of the upstream flow. A second sensor is preferably provided associated with the discharge line of the turbocompressor for sensing pressure in the discharge line and formulating a signal representative of the discharge pressure. One of the discharge pressure and volumetric pressure are then fed to a function generator in which the linear input signal is converted into a non-linear output signal. The input signal such as a signal representative of pressure may be fed into the function generator and the output signal of the function generator based on the blow-off curve will be the minimum allowable compressor flow (volumetric rate of flow) which is determined by the blow-off line. Alternatively, a signal processing means may be utilized which compares one of the volumetric rate of flow and discharge pressure with information stored in a memory device and outputs a set point signal based on the theoretical discharge pressure or volumetric rate of flow given the working point of the turbocompressor.

By acting directly upon the integral section of the control by means of the correcting signal the control signal is transferred instantaneously to the outlet of the controller, in order to cause a fast opening of the blow-off valve. In the course of this the controller outlet signal immediately adopts the value, which is needed after the disturbance. That is a longer time of compensation, during which the controller outlet adjusts subsequently to the new value, is not necessary.

In the alternative embodiment the correction signal is lead to the integral section as a control signal and the integration time constant (reset time) is modified as a function of the position of the working point. Thus in critical conditions of operation a fast reaction of the control it is guaranteed, since in the case of a crossing of the safety line the reset time of the control is reduced.

The various features of novelty which characterize the invention are pointed out with particularity in the claims annexed to and forming a part of this disclosure. For a better understanding of the invention, its operating advantages and specific objects obtained b its uses, reference is made to the accompanying drawings and descriptive matter in which preferred embodiments of the invention are illustrated.

DESCRIPTION OF THE PREFERRED EMBODIMENTS

Figure 1:
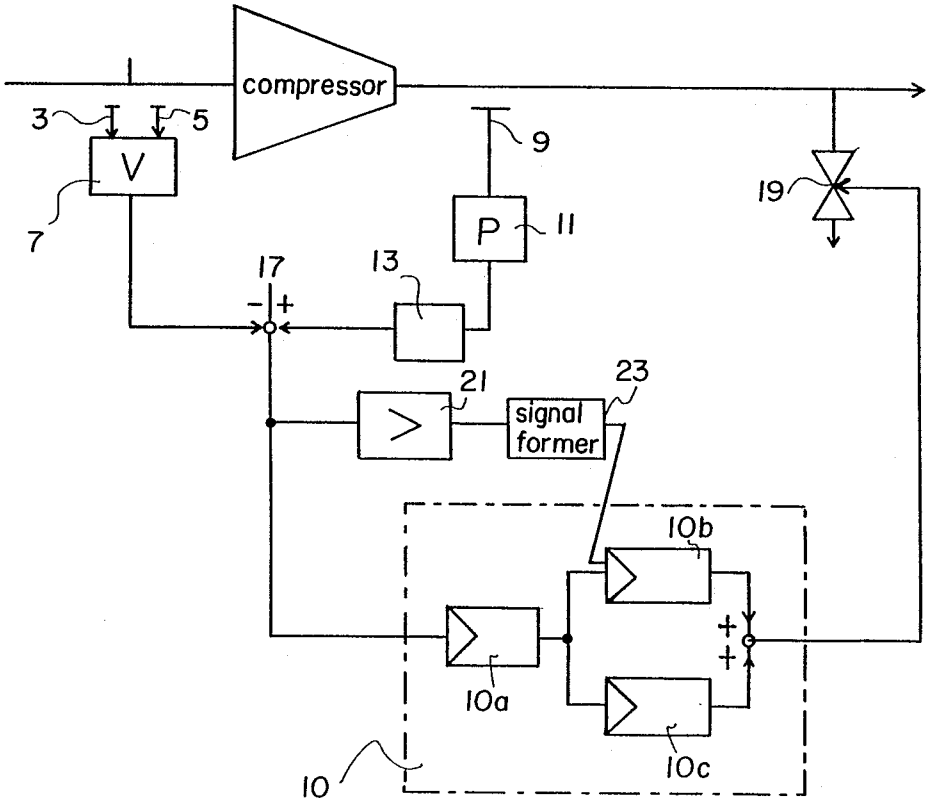
FIG. 1 is a schematic representation of the control system of the invention, in which a correction signal is carried directly to the integral section.

Referring to the drawings in particular, the invention embodied therein comprises a device for controlling a turbocompressor K to prevent surge. The device comprises a function generator 13 connected to at least one of a sensor transducer 7 and a sensor transducer 11. The transducers 7 and 11 are in turn connected to the suction and discharge of the compressor for detecting the actual value of one or more operating variables. The sensed operating variables are converted at the transducer into electrical signals representative of the characteristics of the instantaneous working point of the compressor (e.g. volumetric rate of flow and discharge pressure).

The signal representative of the working point or operating variables of the turbocompressor is used to form a controller input signal for the controller 10. The controller input signal may be formed using generally standard principals. Preferably, the value of the signal representing discharge pressure (output from transducer 11) is compared to the blowoff curve to determine the minimum allowable compressor flow (volumetric rate of flow) for that discharge pressure. A set point signal representative of this theoretical minimum allowable compressor flow is then subtracted, at subtractor 17, from the signal representative of the actual sensed volumetric rate of flow. The control input signal is then formed based on the difference between the set point signal (volumetric rate of flow value from the blow-off line which corresponds to the pressure value sensed) and the volumetric rate of flow sensed.

As the person skilled in this art will appreciate, the role of the parameters (discharge pressure and volumetric rate of flow) may be reversed. That is the actual volumetric rate of flow may be compared to the blow off curve to determine the corresponding theoretical discharge pressure along the blow-off curve. The difference between the theoretical discharge pressure signal (set point signal) and the actual discharge pressure signal will then form the controller input signal.

The person of ordinary skill in the art will also appreciate that other turbocompressor parameters may be used employing the same principals to form a controller input signal. The embodiments disclosed utilize the discharge pressure signal to form the setpoint signal.

In the intake line (suction connection piece) 1 of a compressor K the pressure difference is measured in front of and behind of a throttling screen (blind or venturi etc.) by a sensor 3, 5 and out of this value an actual value for the throughput or volumetric rate of flow V on the suction side is formed in a measuring transmitter or transducer 7.

A sensor 9 with measuring transmitter or transducer 11 registers the end pressure or discharge pressure P of the compressor.

Figure 2:
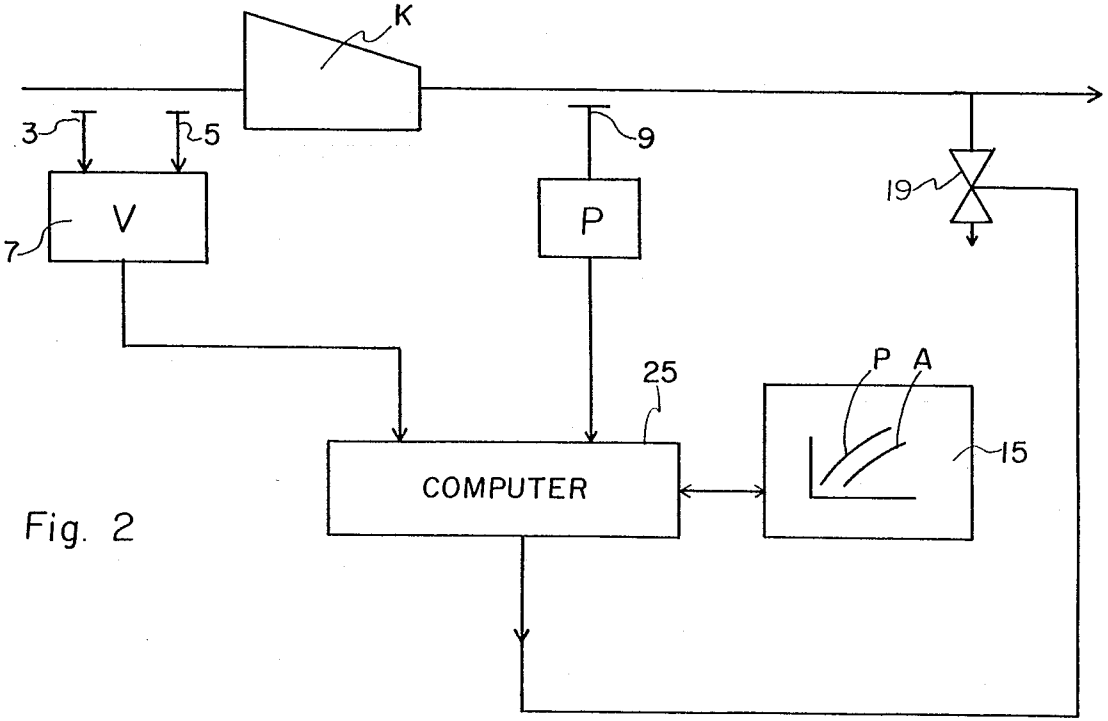
FIG. 2 is a schematic representation of the control system using digital controls; and, FIG. 3 is a circuit diagram of the signal former and integral controller of an analog realization of the invention.

For a digital system the actual-values are fed to a computer 25, to which a memory (storage) 15 is connected, in which the course of the surge limit line P and/or of a blow-off line A, running at a safety distance from it is stored (see FIG. 2). That is, tranducer outputs a digital signal representing the discharge pressure sensed. The computer 25 uses a program which compares the digital input, one of the sensed flow parameters (discharge pressure) with a value for volumetric rate of flow which corresponds to this digital input. This comparison is made from the stored memory 15 which has the pressure—volumetric flow data (representing the blow-off curve and /or surge limit curve) stored in digital form. For example, for each input pressure signal the computer outputs a signal representing the corresponding flow rate. This output signal (in digital form) is a set-point-signal, which is compared to the actual-value-signal, in order to form the controller input signal for the controller. These features of forming a control input signal are generally standard.

Figure 3:
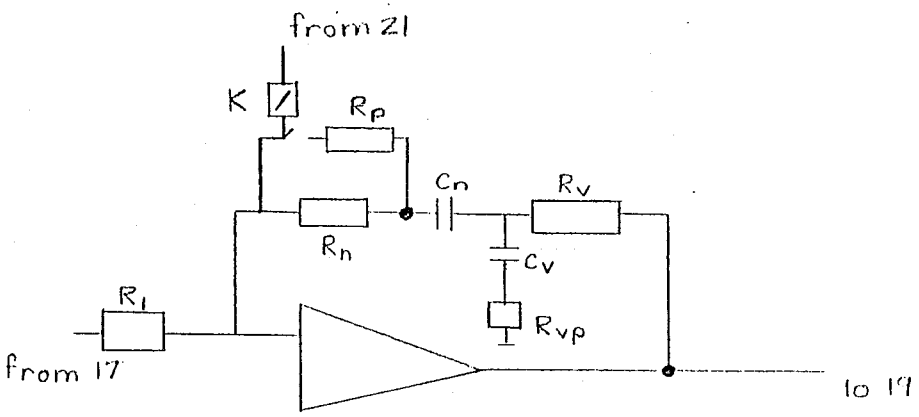

As an alternative an analog system may be employed (see FIG. 3), in which the input signal (for example, pressure) is directly input to a function generator **13*a*. This function generator 13*a* receives a linear input signal and converts it to a non-linear output. According to the embodiment of FIG. 1, the input signal to the function generator 13*a* is the output signal of transmitter 11, which signal is representative of the discharge pressure. The output signal of the function generator is the minimum allowable compressor flow (volumetric rate of flow) which is determined by the blow-off line set in the function generator 13*a*. The output signal of the function generator 13*a* is the set point signal. This set point signal is directed to subtractor 17 which forms the difference between the set point signal and the signal from tranducer 7. This difference (output by element 17) forms the controller input signal. This feature of forming the setpoint signal and the controller input signal is again generally standard in this field. For example, the analog realization of the formation of the setpoint signal and controller input signal may be effected by employing a chain of diodes. Such function generator units such as function generator unit 13*a***, are commercially available to perform precisely this function, i.e. Siemens Model Teleperm C/M 74005-A310.

As the reader will appreciate from the following, the invention primarily relates to the controller 10 (or control program of computer 25) and the treatment signals after the set point signal is formed from function generator **13*a* (or computer 25**) to form the control input signal. The present invention is directed to the conditioning of the control signal in the controller, so the controller output signal properly controls the blow-off valve in situations in which a quick response is needed.

This controller comprises at least one proportional section **10*a* and an integral section 10*b* (PI controller) and may include a differential section 10*c* as well (PID controller). The output signal of the controller 10 operates (controls) a blow-off valve 19**, which is responsive to the output signal and which opens and closes in response to the value of the controller output signal. The blow- off valve when open allows for a relief of pressure in the discharge line by diverting compressed fluid from the compressor discharge output (outlet).

The output signal Y of an integral-proportional controller is a function of the integration time constant (reset time) $T_N$, of the proportional sensitivity KP and of the controlled difference $X_d$:

$$Y = KP\left(X_d + \frac{1}{T_n}\int_0^{\tau} X_d\,dt\right)$$

When the values KP and $T_N$ are given, determined by the requirements of stability in the entire working area, Y changes only slowly, as long as $X_d$ does not adopt any values.

The control difference $X_d$, meaning the distance between the working point and the blow-off line is relatively small, in the area which is close to the blow-off line, and thus the modification of the output signal of the controller Y is effected only slowly. However, this does not meet the requirement , that the controller should react quickly when the blow-off line is crossed.

When fast changes happen, the controller may not be able to open the blow-off valve fast enough. Reasons for this may be the adjustment of the controller (parameters of the controller) because this controller has to be tuned so that stable control function is guaranteed whatever may happen. In this case the measured flow may go lower than allowed and the difference between actual flow (output of transmitter 7) and the desired flow (output of function generator 25) will become positive. This positive deviation will be detected by the threshold signaler 21. This is a unit which works like a switch. If the input signal is below a preset limit level, the output is zero. If the input signal is above the limit, the output signal goes to "1" (full signal). The output of the threshold is directed to a signal former 23. The realization of the signal former 23 depends upon whether the whole system is realized by analog controls or digital controls.

FIG. 1 shows a typical realization of a PID-Controller. The integral function is made by an operational amplifier which has a resistor and a capacitor in the feedback line (see FIG. 3). The integral action of the controller is determined by the time constant Tn=Rn *Cn. This value is selected to give good control response for normal operation. During the above mentioned upsets (fast changes), this response may be too slow. A smaller time constant will be required to give faster control response. This is done by the parallel resistor Rp. If this is switched in, the time constant Tn is given by $$Tn^* = \frac{Rn * Rp}{(Rn + Rp)}\,Cn$$

Resistor Rp has to selected such that the time constant Tn* corresponds to the maximum operating speed of the blow-off valve.

If opening of the blow-off valve with maximum speed is required (control input signal positive, difference between actual flow and desired flow), the resistor Rp has to be switched in. This can be done via the Relay which is activated by the threshold signaler 21. If the input value of the threshold is above the limit, the relay will be energized and the contact is closed. After the input signal of the threshold has fallen below the limit value, the relay K will de-energize again, the contact will open and the original time constant Tn will be set.

Resistor rl is the input resistor, resistors Rv and Rvp as well as capacitor Cv are part of the derivative action of the controller.

The signal former section 23 can be formed in such a way, that it generates the correction signal provided the working point is lying at the left side of the safety -or blow-off line. However, it is possible as well, that the signal former step 23 generates a correction impulsation of a defined, adjustable duration. Or several impulsations can be generated subsequently, which cause a modification of the content of the integrator in several steps of adjustable height in adjustable time lags.

Furthermore it is possible to control the value of the correcting signal, generated by the signal transmitter 23 or to control the distance of the impulsations or the time constant dt as a function of the input signal of the controller. Thus the influence of the correcting signal can not only be dependent upon the fact, whether or not the safety line is crossed, but as well with how far and/or with which speed it is crossed. This influence can not be carried out linearly and may only be limited by one operational sign.

With this advantageous arrangement the response of the controller is quick in situations where it must be and the problems of the prior art are overcome. The advantages also hold true for the digital arangement.

FIG. 2 shows the control system using a digital controls with aspects of the control programmed in a standard language.

These standard programming languages are those like Assembler, Fortran, Basic, C etc. With these languages the controller output signal has to be calculated according to the formula $$Y = KP\left(e + \frac{1}{t_n}\int e\,dt + T_v\frac{de}{dt}\right)$$

In this formula, y stands for the controller output signal, e for the control deviation (output of comparing unit 17), KP is the proportional gain of the controller, Tn is the integral time constant and Tv the derivative time constant.

All elements except the compressor, the transmitter 7 and 11 and the blow-off valve are now parts of a computer program. The function generator is a pair of values as mentioned above, controller 10 and comparing unit 17 are just instructions such as e:=setpoint - actual flow if e limit than go to fastchange $$y := Kp\left(e + \frac{1}{t_n}\int e\,dt + T_v\frac{de}{dt}\right)$$

fastchange y:=y - step the value "step" stands for the required change of controller output within on computer cycle. It is preferred to set step the value $$\text{step} = \frac{\text{stroking time of blow-off valve}}{\text{scanning time of computer}}$$

the scanning time is the time interval between two calculations, which is the time between two changes of the controller output signal. With this setting, the blow-off valve will open with the fastest speed if subroutine fastchange is performed.

While specific embodiments of the invention have been shown and described in detail to illustrate the application of the principles of the invention, it will be understood that the invention may be embodied otherwise without departing from such principles.

What is claimed is:

1. A turbocompressor control for use with a turbocompressor having an inlet connected to an upstream line and an outlet connected to a downstream line, comprising:

first sensor means, connected to the upstream line, for sensing the volumetric rate of flow in the upstream line and for producing a signal representative of said volumetric rate of flow sensed;

second sensor means, connected to the downstream line, for sensing the discharge pressure in the downstream line and for producing a signal representative of said discharge pressure;

a blow-off valve connected to said downstream line for relieving the discharge pressure;

function generator means for receiving said discharge pressure signal and for generating a set point signal representing a minimum volumetric flow rate from the blow-off curve corresponding to the discharge pressure sensed;

difference means for outputting a control signal representative of the difference between the set point signal and the signal representative of the volume rate of flow;

threshold means for receiving said control signal and detecting the control value of the control signal passing a predetermined threshold and outputting a trigger signal when the control signal has passed the predetermined threshold;

control means for receiving said control signal and said trigger signal, said control means including a proportional controller receiving said control signal and outputting a signal having a value proportional to said set point signal, an integral controller for receiving said control signal and outputting a signal which is the integral of said set point signal, as a function of time, and a signal-forming stage for receiving said trigger signal and generating a correction signal, said correction signal being input to said integral controller so as to intensify the output of said integral controller.

2. A turbocompressor control according to claim 1, further comprising an adjustable time delay connected to said controller, said correction signal being fed to said integral controller via said adjustable time delay.

3. A turbocompressor control according to claim 1, wherein: said control means includes a differential controller.

4. In a turbo compressor control for use with a turbo compressor having an inlet connected to an upstream line and a outlet connected to a downstream line, with a first sensing means to sense a first turbo compressor parameter, and second sensing means to sense a second turbo compressor parameter, means to create a set point signal based on a theoretical compressor parameter corresponding to one, of the sensed turbo compressor parameters and difference means for formulating the difference between the theoretical compressor parameter and the other of the turbo compressor parameters to formulate a control input signal, comprising:

A controller including a proportional controller and an integral controller, said controller receiving said control input signal and outputting a control signal;

limit means associated with said controller for receiving said control input signal and detecting when said control input signal exceeds a predetermined limit and for outputting a threshold signal representative of said control input signal passing said predetermined limit; and, signal former means, receiving said threshold signal and outputting a signal directly to said integral controller for changing the integral action of said integral controller.

5. The turbo compressor control according to claim 4, wherein said means for augmenting the integral action of said integral controller includes changing the time constant of the integral controller.

* * * * *